US005385356A

United States Patent [19]

Conte

[11] Patent Number: 5,385,356

[45] Date of Patent: Jan. 31, 1995

[54] SUPPORTING FRAME PARTICULARLY FOR ALIGNED WHEELS OF SKATES

[75] Inventor: Gino Conte, Caerano S. Marco, Italy

[73] Assignee: Roces S.r.l., Italy

[21] Appl. No.: 196,282

[22] Filed: Feb. 10, 1994

[30] Foreign Application Priority Data

Mar. 24, 1993 [IT] Italy ..... TV93 A 000035

[51] Int. Cl.[6] ..... A63C 17/06

[52] U.S. Cl. ..... 280/11.22; 280/11.27; 301/5.3; 301/120

[58] Field of Search ..... 280/11.19, 11.2, 11.22, 280/11.27, 11.3; 301/5.3, 111, 120

[56] References Cited

U.S. PATENT DOCUMENTS 4,988,122 1/1991 Saunders ..... 280/11.19 X 5,048,848 9/1991 Olson et al. ..... 280/11.22

5,068,956 12/1991 Malewicz ..... 280/11.27 X

*Primary Examiner*—Mitchell J. Hill

*Assistant Examiner*—Carla Mattix

*Attorney, Agent, or Firm*—R. Neil Sudol; Henry D. Coleman

[57] ABSTRACT

A supporting frame, particularly for aligned wheels of skates, which is shaped like a "U" on the wings of which there is a plurality of first and second holes having the same axis. These holes constitute seats for removable pivots for the wheels and are respectively partially closed and temporarily closeable at their opposite ends. A sliding bar, slideable in a groove, is used for blocking, at least temporarily, the pivots. The wheels are associable with the supporting frame without requiring screws and thus containing the assembly and general costs of the skate.

9 Claims, 1 Drawing Sheet 1
2b
7
2a
5
3
8
6
5
3
9

102a
108
109
106
112
102b
110
104
114
124
111

1
2a
12
8
6
24
22
4
14
2b 112
109
106

2a
8
6
5
2b
4

SUPPORTING FRAME PARTICULARLY FOR ALIGNED WHEELS OF SKATES

BACKGROUND OF THE INVENTION

1. Field of the Invention

The present invention relates to a supporting frame, particularly for aligned wheels of skates.

2. Description of the Prior Art

Currently, known skates with aligned wheels have a frame which is essentially shaped like a "U", between the ground-facing wings of which there is a plurality of holes at which the stem of a screw for supporting the hub of a wheel is placed; locking occurs for example by using an adapted nut to tighten the screw.

The solution which entails the use of screws, however, has some drawbacks: first of all a certain amount of time is required by the operator to insert the screw, associate the nut therewith and then tighten it; the operator must therefore have available a screwdriver as well as a wrench to lock the nut; during these steps, the screw may be badly tightened on the nut, consequently stripping it and requiring replacement. Furthermore, excessive or insufficient tightening of the screw can entail the uncoupling of the nut or the mutual approach of the wings of the frame: in the first case, the screw can be lost and the wheel thus detaches; in the second case, good rolling does not occur due to friction of the wings of the frame with the wheel.

SUMMARY OF THE INVENTION

A principal aim of the present invention is therefore to solve the drawbacks described above by providing a supporting frame for aligned wheels of skates which allows easy and rapid assembly of said wheels.

Another aim of tile present invention is to provide a frame in which wheel assembly is always optimum and maintained in such conditions even during use of the skate.

Another aim is to obtain a frame which allows the user to replace the wheels in a rapid, simple and anyway accurate manner in case of wear thereof.

A further aim is to obtain a frame which does not require particular tools for the user or assembler.

Another important aim is to provide a frame which is structurally simple and easy to industrialize and has very modest manufacturing costs allowing its universal diffusion and application even on known skate types.

With these aims, and other aims which will become apparent from the following description in view, there is provided, in accordance with the present invention, a U-shaped supporting frame, particularly for aligned wheels of skates, on the ground-facing wings of which there is a plurality of first and second holes having the same axis, characterized in that said first and second holes constitute seats for removable pivots for said wheels and are, at their opposite ends, respectively partially closed and temporarily closeable.

BRIEF DESCRIPTION OF THE DRAWINGS

The characteristics and advantages of the present invention will become apparent from the following detailed description of a preferred embodiment thereof, illustrated by way of non-limitative example in the accompanying drawings, wherein.

DESCRIPTION OF THE PREFERRED EMBODIMENTS

Figures 1, 2, 3, 4, 5:
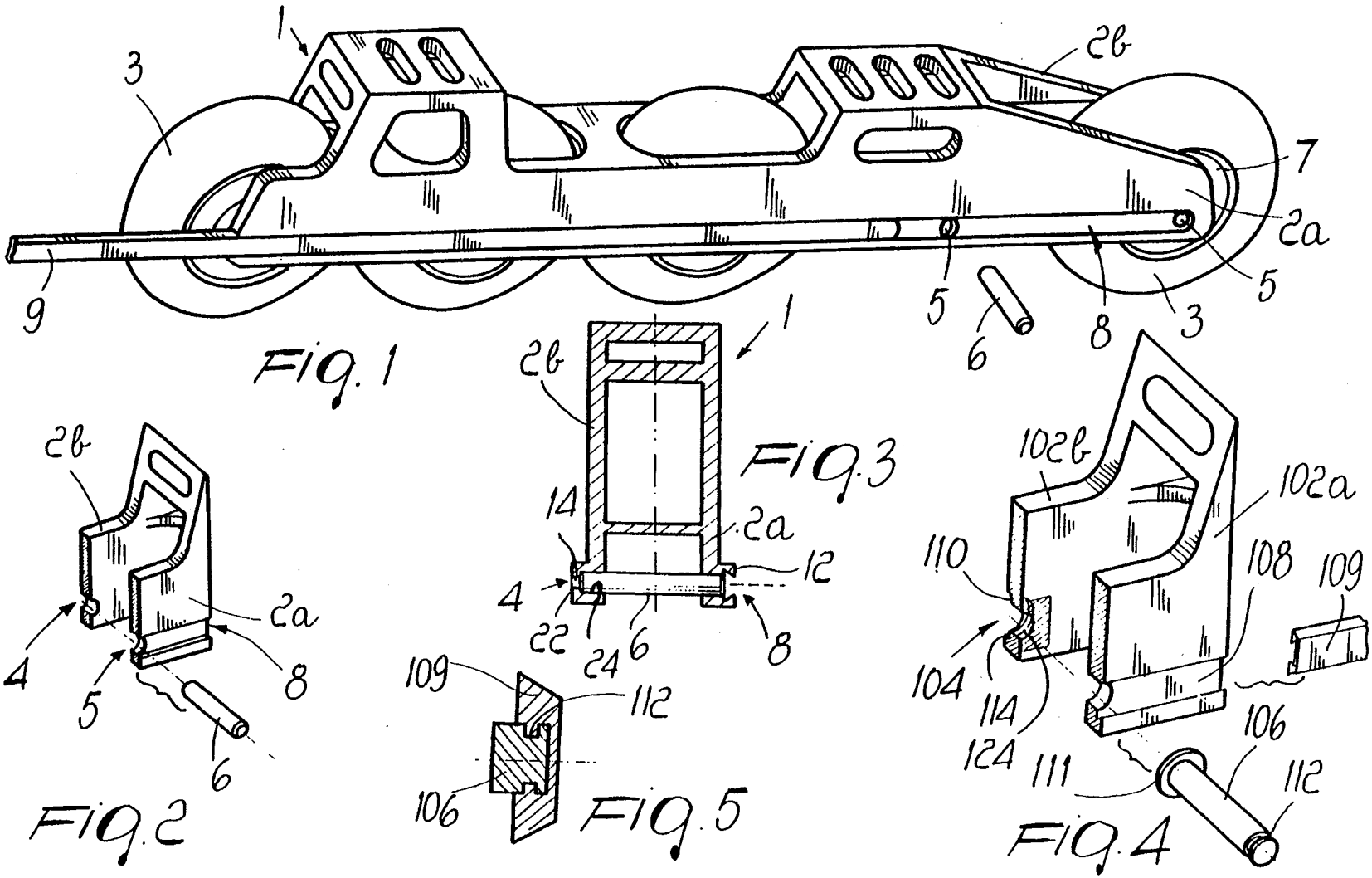
FIG. 1 is a lateral perspective view of the frame according to the present invention.
FIG. 2 is an exploded view of some components of the frame of FIG. 1.
FIG. 3 is a sectional view of the frame of the preceeding figures, taken along an axis of a wheel.
FIG. 4 is a view, similar to FIG. 2, of a further embodiment of the frame.
FIG. 5 shows, in a sectional view, the temporary locking of a pivot.

With reference to the above figures, and considering that they are examples of a particular embodiment and are in variable scale and that identical or equivalent parts are identified by individual reference numerals in said figures, the reference numeral 1 generally designates the frame, essentially U-shaped, having wings 2*a* and 2*b* directed toward the ground.

Said frame 1 allows to rotatably support a plurality of mutually aligned wheels 3 between the wings 2*a* and 2*b*.

A plurality of coaxially paired first holes 4 and second holes 5 is formed at the wings 2*a* and 2*b*; adapted pivots 6 are removably arrangeable at said holes and interact with the hub 7 of the wheels 3.

The first holes d, formed at the wing 2*b*, are partially closed, in that they partially accommodate an end of the pivot 6 which cannot exit through said first holes due to a reduction in diameter provided at said holes (FIG. 3). In other words, first holes 4 in wing element 2*b* each include an outer portion 14 defined by a first diameter and an inner portion 24, facing wing element 2*a*, defined by a second diameter which is larger than the diameter of outer hole portion 14, whereby the holes 4 are partially closed.

The second holes 5 are instead formed at an adapted groove 8 formed longitudinally with respect to the wing 2*a*; the length of the pivots 6 is such that one of their ends is arranged in the first holes 4 and in the second holes 5 without protruding at the groove 8. To that end, each pivot pin 6 has a length less than a distance between outer surfaces 12 and 22 of wing elements 2*a* and 2*b*, so that upon insertion of the pivot pins through respective holes 5 and into associated holes 4 the pins are located between the outer surfaces 12 and 22 of the wing elements 2*a* and 2*b*.

A complementarily shaped bar 9 is slideably associable with said groove, which preferably has a dovetail cross-section; said bar is inserted and subsequently locked within the groove 8, so as to at least temporarily close the second holes 5, thus preventing the escape of the pivots 6.

Assembly of the skate is thus as follows: once the assembler has inserted the wheels between the wings of the frame, the pivots 6 are positioned through the second holes 5 and accommodated within the first holes 4. It is subsequently sufficient to insert the bar 9 within the groove 8, temporarily closing the second holes 5 and thus locking, for example by means of an adapted screw, the position of said bar 9. In this manner, the wheels are optimally supported by the pivots 6, said pivots being riot able to leave their seats in any manner. For possible replacement it is sufficient to remove the bar 9 and, at the first hole 4, force the exit of the pivot 6 by means of a pin or any other pointed object.

It has thus been observed that the frame has achieved the intended aims, allowing to rapidly and easily assemble the wheels. Assembly is simple, easy, rapid and always optimum, since its precision depends on the dimensions of the pivots and of the first and second holes and not on the operator's skill.

Retention of the pivots in their position is ensured by the presence of the bar 9 and by the fact that the first holes 4 have, at one end, a slightly smaller diameter than said pivots 6.

Wheel replacement is equally rapid and simple and can be performed even directly by the user, who can in any case restore the optimum conditions during reassembly.

FIGS. 4 and 5 illustrate a solution in which the first holes 104 formed on the wing **102*b* have, on the outside of said wing, an annular seat 110 at which the head 111 of the pivot 106 is arranged. Annular seat 110 is defined by an outer hole portion 114 and an inner hole portion 124, facing wing element 102*a*, where the inner hole portion 124 has a diameter which is less than the diameter of the outer hole portion 114. At its other end, the pivot 106 has an annular groove 112 protruding at the groove 108 so that it can selectively engage a complementarily shaped seat formed on tile bar 109 (FIG. 5**). This situation, too, provides optimum locking of the pivot without requiring particular tools and achieves in any case the correct placement of the pivot, which can be achieved again every time the wheels are changed or subjected to maintenance.

The materials and the dimensions of the individual components of the frame may vary according to many requirements.

I claim:

1. A supporting frame assembly for aligned wheels of a roller skate, comprising:

a pair of substantially parallel wing elements connected to one another, said wing elements each having an outer surface facing away from the other of said wing elements, one of said wing elements being provided with a plurality of first holes, another of said wing elements being provided with a plurality of second holes coaxially aligned with respective ones of said first holes, said first holes each having an outer portion defined by a first diameter and an inner portion, facing said another of said wing elements, defined by a second diameter larger than said first diameter, whereby said first holes are partially closed;

a plurality of wheel-supporting pivot pins each having a length less than a distance between the outer surfaces of said wing elements, said pivot pins being inserted through respective ones of said second holes and into associated ones of said first holes so that said pins are located between the outer surfaces of said wing elements; and means separate from said pivot pins for temporarily covering said second holes at the outer surface of said another wing element upon insertion of said pivot pins through respective ones of said second holes and into associated ones of said first holes and for thereby preventing removal of said pivot pins from said first holes and said second holes.

2. The assembly defined in claim 1 wherein said another of said wing elements is formed at the respective outer surface with a groove extending over said second holes, said length of said pivot pins being such that said pivot pins do not protrude into said groove upon insertion of said pivot pins through respective ones of said second holes and into associated ones of said first holes.

3. The assembly defined in claim 2 wherein said means for covering includes a bar slidably disposed in said groove.

4. The assembly defined in claim 3, further comprising means for locking said bar in said groove.

5. The assembly defined in claim 4 wherein said groove and said bar have complementary shapes, said means for locking including said complementary shapes.

6. The assembly defined in claim 5 wherein said complementary shapes are dovetailing shapes.

7. A supporting frame assembly for aligned wheels of a roller skate, comprising:

a pair of substantially parallel wing elements connected to one another, said wing elements each having an outer surface facing away from the other of said wing elements, one of said wing elements being provided with a plurality of first holes, another of said wing elements being provided with a plurality of second holes coaxially aligned with respective ones of said first holes, said first holes each having an outer portion defined by a first diameter and an inner portion, facing said another of said wing elements, defined by a second diameter smaller than said first diameter, whereby said first holes are partially closed;

a plurality of wheel-supporting pivot pins having respective heads at one end and respective locking formations at an opposite end, said pivot pins being inserted through respective ones of said first holes and through associated ones of said second holes so that each of said heads is seated in said outer portion of a respective one of said first holes; and locking means separate from said pivot pins for temporarily covering said second holes at the outer surface of said another wing element upon insertion of said pivot pins through respective ones of said first holes and through associated ones of said second holes and for cooperating with said locking formations to lock said pivot pins, thereby preventing removal of said pivot pins from said first holes and said second holes.

8. The assembly defined in claim 7 wherein said locking formations include annular grooves in said pivot pins and wherein said locking means includes a bar received in a groove on said another of said wing elements, said bar being provided with a plurality of seats for complementarily engaging respective ones of said pivot pin annular grooves.

9. The assembly defined in claim 8, further comprising means for locking said bar in said groove.

* * * * *